US008191601B2

(12) United States Patent
Okachi et al.

(10) Patent No.: US 8,191,601 B2
(45) Date of Patent: Jun. 5, 2012

(54) SCREEN DEVICE

(75) Inventors: Yasubumi Okachi, Kanagawa (JP); Yuichiro Nishioka, Kanagawa (JP)

(73) Assignee: Metaco Inc., Tokyo (JP)

( * ) Notice: Subject to any disclaimer, the term of this patent is extended or adjusted under 35 U.S.C. 154(b) by 253 days.

(21) Appl. No.: 12/513,899

(22) PCT Filed: Nov. 9, 2007

(86) PCT No.: PCT/JP2007/071825

§ 371 (c)(1),
(2), (4) Date: Dec. 28, 2009

(87) PCT Pub. No.: WO2008/056783

PCT Pub. Date: May 15, 2008

(65) Prior Publication Data

US 2010/0096093 A1 Apr. 22, 2010

(30) Foreign Application Priority Data

Nov. 10, 2006 (JP) ..... 2006-305105

(51) Int. Cl.

| | |
|---|---|
| ***E06B 9/08*** | (2006.01) |
| ***E06B 9/56*** | (2006.01) |
| ***A47H 1/00*** | (2006.01) |
| ***A47G 5/02*** | (2006.01) |

(52) U.S. Cl. ..... 160/122; 160/245; 160/31; 160/305

(58) Field of Classification Search ..... 160/23.1, 160/84.06, 31, 194, 201, 240, 268.1, 271, 160/272, 277, 279, 122, 245, 305

See application file for complete search history.

(56) References Cited

U.S. PATENT DOCUMENTS

| | | | | | |
|---|---|---|---|---|---|
| 669,321 | A | * | 3/1901 | Holwager et al. | 160/121.1 |
| 1,469,150 | A | * | 9/1923 | Church | 160/121.1 |
| 3,306,344 | A | * | 2/1967 | Youngs | 160/241 |
| 4,433,630 | A | * | 2/1984 | Laborie | 108/50.02 |
| 4,433,711 | A | * | 2/1984 | Lew | 160/120 |
| 4,809,760 | A | * | 3/1989 | Lew | 160/120 |
| 4,848,437 | A | * | 7/1989 | Laniado et al. | 160/370.22 |
| 4,862,942 | A | * | 9/1989 | Johnson | 160/99 |

(Continued)

FOREIGN PATENT DOCUMENTS

| | | |
|---|---|---|
| JP | 63-98989 | 6/1988 |

(Continued)

OTHER PUBLICATIONS

International Search Report mailed Dec. 4, 2007 for International Application No. PCT/JP2007/071825.

*Primary Examiner* — Blair M Johnson
*Assistant Examiner* — Jaime F Cardenas-Garcia
(74) *Attorney, Agent, or Firm* — Wenderoth, Lind & Ponack, L.L.P.

(57) ABSTRACT

A weight moving in a height direction interlocking with development and reception of a slide guide frame is provided, and the weight brakes reception of the slide guide frame owing to an increase in potential energy and promotes development of the slide guide frame owing to a decrease in potential energy, whereby an operating force is decreased, a feeling of operating a slide bar is made light, and the slide bar is decreased in sliding speed at the time of closing to achieve an improvement in safety.

4 Claims, 5 Drawing Sheets

U.S. PATENT DOCUMENTS

| | | | | |
|---|---|---|---|---|
| 4,993,468 | A * | 2/1991 | Hackman et al. | 160/27 |
| 5,176,774 | A * | 1/1993 | Laniado et al. | 156/162 |
| 5,377,737 | A * | 1/1995 | Moriya et al. | 160/84.06 |
| 5,443,923 | A * | 8/1995 | Laniado et al. | 428/476.1 |
| 6,082,432 | A * | 7/2000 | Kissinger | 160/290.1 |
| 6,186,212 | B1 * | 2/2001 | Tsuchida | 160/84.06 |
| 6,318,438 | B1 * | 11/2001 | Uno et al. | 160/31 |
| 6,766,847 | B1 * | 7/2004 | Wang | 160/199 |
| 7,472,738 | B2 * | 1/2009 | Kamosawa et al. | 160/84.06 |
| 7,487,816 | B2 * | 2/2009 | Moriya et al. | 160/31 |
| 7,669,632 | B2 * | 3/2010 | Moriya et al. | 160/31 |
| 7,694,711 | B2 * | 4/2010 | Okachi et al. | 160/245 |
| 7,717,152 | B2 * | 5/2010 | Moriya et al. | 160/31 |
| 7,730,926 | B2 * | 6/2010 | Moriya et al. | 160/84.06 |
| 7,931,070 | B2 * | 4/2011 | Chino et al. | 160/194 |
| 7,963,312 | B2 * | 6/2011 | Okachi et al. | 160/31 |
| 2007/0029053 | A1 * | 2/2007 | Moriya et al. | 160/84.06 |
| 2007/0039698 | A1 * | 2/2007 | Chino et al. | 160/84.06 |
| 2007/0068633 | A1 * | 3/2007 | Chino et al. | 160/31 |
| 2007/0209767 | A1 * | 9/2007 | Bonini | 160/382 |
| 2008/0053629 | A1 * | 3/2008 | Moriya et al. | 160/272 |
| 2008/0135189 | A1 * | 6/2008 | Okachi et al. | 160/84.06 |
| 2009/0145560 | A1 * | 6/2009 | Donatelli et al. | 160/323.1 |

FOREIGN PATENT DOCUMENTS

| | | |
|---|---|---|
| JP | 2-122891 | 10/1990 |
| JP | 4-42598 | 4/1992 |
| JP | 5-40593 | 6/1993 |
| JP | 6-58095 | 8/1994 |
| JP | 2001-73655 | 3/2001 |
| JP | 2005-351046 | 12/2005 |
| WO | 2005/121488 | 12/2005 |

* cited by examiner

SCREEN DEVICE

BACKGROUND OF THE INVENTION

I. Technical Field

The present invention relates to a screen device that can be used as curtain, blind, screen, partitioning, etc.

II. Description of the Related Art

The applicant of the present application has proposed a versatile screen device being ready, smooth, and stable in opening and closing operations (JP-A-2005-351046).

As shown in FIG. 5, a slide bar 2 being slidable relative to a stationary frame 1 is provided on a screen device. Also, a pair of slide guide frames 3 are provided, the slide guide frames 3 being developed from and received in the slide bar 2 as the slide bar 2 slides. A rotatable roller pipe 4 is arranged between the pair of slide guide frames 3. The rotatable roller pipe 4 is also slidable along the slide guide frames 3. One end of each of two screens 5 are fixed to the roller pipe 4. In the case where the roller pipe 4 is single, as shown in FIG. 5, one end of each of the single screens 5 is fixed to the roller pipe 4. Of the screens 5, the other end of one screen is fixed to the slide bar 2 and the other end of the other screen is fixed to the stationary frame 1. The two screens 5 are wound round the roller pipe 4 when the screen device is opened. The roller pipe 4 receives therein a coil spring, and when the slide bar 2 is slid to pull out the screens 5 at the time of closing of the screen device, the roller pipe 4 is rotated and slid in a direction, in which the slide bar 2 is slid, so that an elastic restoring force is accumulated in the coil spring. When the screen device is opened, the elastic restoring force accumulated in the coil spring is released whereby the roller pipe 4 is reversely rotated to wind the screens 5 thereround and is slid toward the stationary frame 1 to slide the slide bar 2 toward the stationary frame 1.

The slide guide frames 3 are formed by connection of a plurality of rigid units 6 to be bendable in one direction and not to bend in the other direction to hold straightness and are fixed at one end thereof to the stationary frame 1. The other end of each of the slide guide frames 3 is free to enable development from and reception in the stationary frame 1.

SUMMARY OF THE INVENTION

The following improvements, which should be achieved, are found in the screen device described above in order to heighten its performance.

The coil spring received in the roller pipe 4 puts the slide bar 2 in a state of being pulled toward the stationary frame 1 at all times. Therefore, when the screens 5 wound round the roller pipe 4 are pulled out in closing the screen device, an operating force that is larger than a force of the coil spring required for winding of the screens 5 is needed, and therefore the operation of the slide bar 2 feels heavy. This tendency becomes significant when the tension of the screens 5 is made larger than the force required for winding in order to prevent the screens 5 from being bent by wind pressure at the time of closing the screen device.

Also, since the slide bar 2 is pulled toward the stationary frame 1 at all times, the slide bar 2 automatically slides at the time of opening of the screen device, but there is the fear that the slide bar 2 will be forcibly slid so as to threaten safety.

The invention has been thought of in view of the above situation and has as an object, providing a screen device, in which the operating force is decreased so as to make a nimble feeling, with which a slide bar is operated, and the sliding speed of the slide bar is decreased in at the time of closing to achieve an improvement in safety.

The screen device according to the invention includes the following features in order to solve the problem described above.

First, a screen device comprises a rotatable roller pipe arranged between a pair of slide guide frames capable of development from and reception in a slide bar being slidable relative to a stationary frame, the roller pipe also being capable of sliding in a sliding direction of the slide bar, the roller pipe having fixed thereto one end of each of two screens to enable the screens to be wound around and pulled out from the roller pipe, the roller pipe receiving therein a coil spring, the roller pipe rotating and sliding in the sliding direction of the slide bar to accumulate an elastic restoring force in the coil spring when the slide bar is slid to pull out the screens, the accumulated elastic restoring force being released to cause the screens to be wound around the roller pipe, the roller pipe sliding toward the stationary frame, and the slide bar also sliding toward the stationary frame, the screen device being characterized in that a weight is provided to move in the height direction interlocking with development and reception of the slide guide frames, and the weight brakes reception of the slide guide frames owing to an increase in potential energy and promoting development of the slide guide frames owing to a decrease in potential energy.

Second, the weight is received in the slide bar in the first feature.

Third, the slide guide frames are also capable of development from and reception in the stationary frame and the weight is received in at least one of the slide bar and the stationary frame in the first feature.

According to the first aspect of the invention, since the weight moving in the height direction interlocking with development and reception of the slide guide frames brakes reception of the slide guide frames owing to an increase in potential energy, it is possible to decrease the slide bar in sliding speed at the time of closing of the screen device. Accordingly, the screen device is improved in safety.

Also, since the weight promotes development of the slide guide frames owing to a decrease in potential energy, it is possible to decrease an operating force applied to the slide bar at the time of closing of the screen device, so that an operation feeling is nimble.

According to the second aspect of the invention, since the weight is received in the slide bar, an outward appearance can be maintained favorable as heretofore and the storage space for the slide guide frame formed on the slide bar can be effectively used for reception of the weight, in addition to the effect of the first aspect of the invention.

According to the third aspect of the invention, since the slide guide frames are also made to be capable of development from and reception in the stationary frame, a length, over which the slide guide frames are developed, is not limited only to the length of the slide bar but elongated, in addition to the effect of the first aspect of the invention. With such a screen device, since the weight is received in at least one of the slide bar and the stationary frame, the storage space for the slide guide frame formed on the slide bar or the stationary frame can effectively be used for reception of the weight while a favorable outward appearance is maintained.

DETAILED DESCRIPTION OF THE INVENTION

Figure 1:
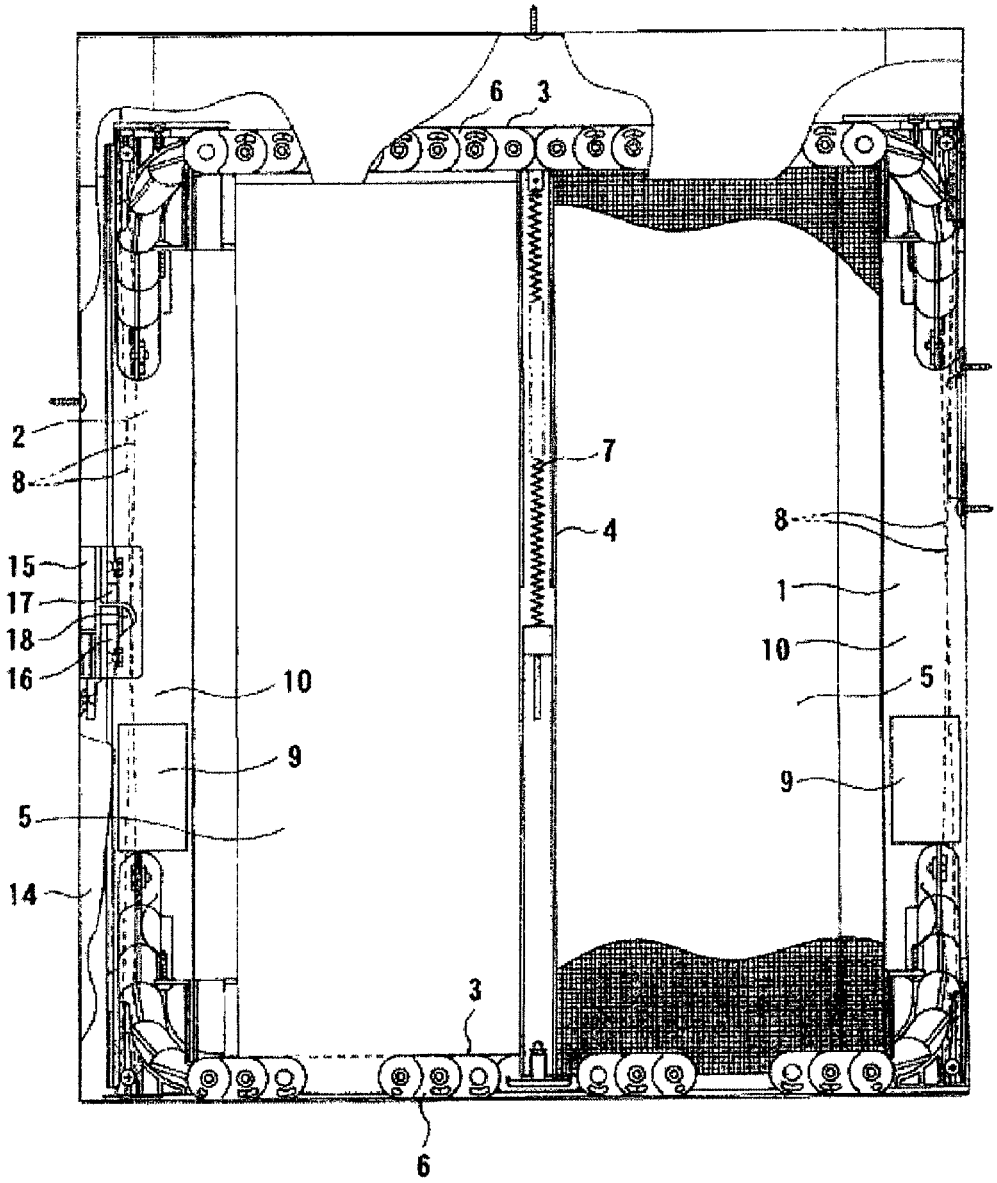
FIG. 1 is a front view showing an embodiment of a screen device, according to the invention, with a part thereof cut out.

FIG. 1 is a front view showing an embodiment of a screen device, according to the invention, with a part thereof cut out.

With the screen device shown in FIG. 1, a slide bar 2 is provided to be slidable horizontally relative to a stationary frame 1. A pair of slide guide frames 3 are provided above and below, the respective slide guide frames 3 being formed by connection of a plurality of rigid units 6. The slide guide frames 3 can bend in one direction but do not bend in the other direction to hold straightness. Both ends of the slide guide frames 3 are free to enable development from and reception in both the slide bar 2 and the stationary frame 1. That is, as the slide bar 2 slides, the slide guide frames 3 are developed from the slide bar 2 and the stationary frame 1 and received in the slide bar 2 and the stationary frame 1. In a state of being developed, the slide guide frames 3, respectively, define upper and lower frames of the screen device.

A rotatable roller pipe 4 is arranged between the pair of slide guide frames 3. The roller pipe 4 is also slidable in a direction, in which the slide bar 2 is slid. One end of each of the two screens 5 is fixed to the roller pipe 4. The other ends of the respective screens 5 are fixed to the slide bar 2 and the stationary frame 1, respectively, and the screens 5 are wound round the roller pipe 4. The roller pipe 4 receives therein a coil spring 7. When the slide bar 2 is horizontally slid at the time of closing of the screen device, the roller pipe 4 is rotated and the screens 5 are pulled out from the roller pipe 4. At the same time, the slide guide frames 3 are developed from the slide bar 2 and the stationary frame 1. As the slide bar 2 slides, the roller pipe 4 slides in a direction, in which the slide guide frames 3 are developed. At this time, an elastic restoring force is accumulated in the coil spring 7 received in the roller pipe 4. Therefore, when the screen device is closed, the screen device is biased in a direction of opening at all times.

When the screen device is opened, the elastic restoring force accumulated in the coil spring 7 is released. Then, the roller pipe 4 is reversely rotated to wind the screens 5 thereround and slid in a direction, in which the slide guide frames 3 are received, that is, toward the stationary frame 1. At this time, the slide bar 2, to which the screens 5 are fixed, is also slid toward the stationary frame 1. The slide guide frames 3 are received in the slide bar 2 and the stationary frame 1.

Figure 5:
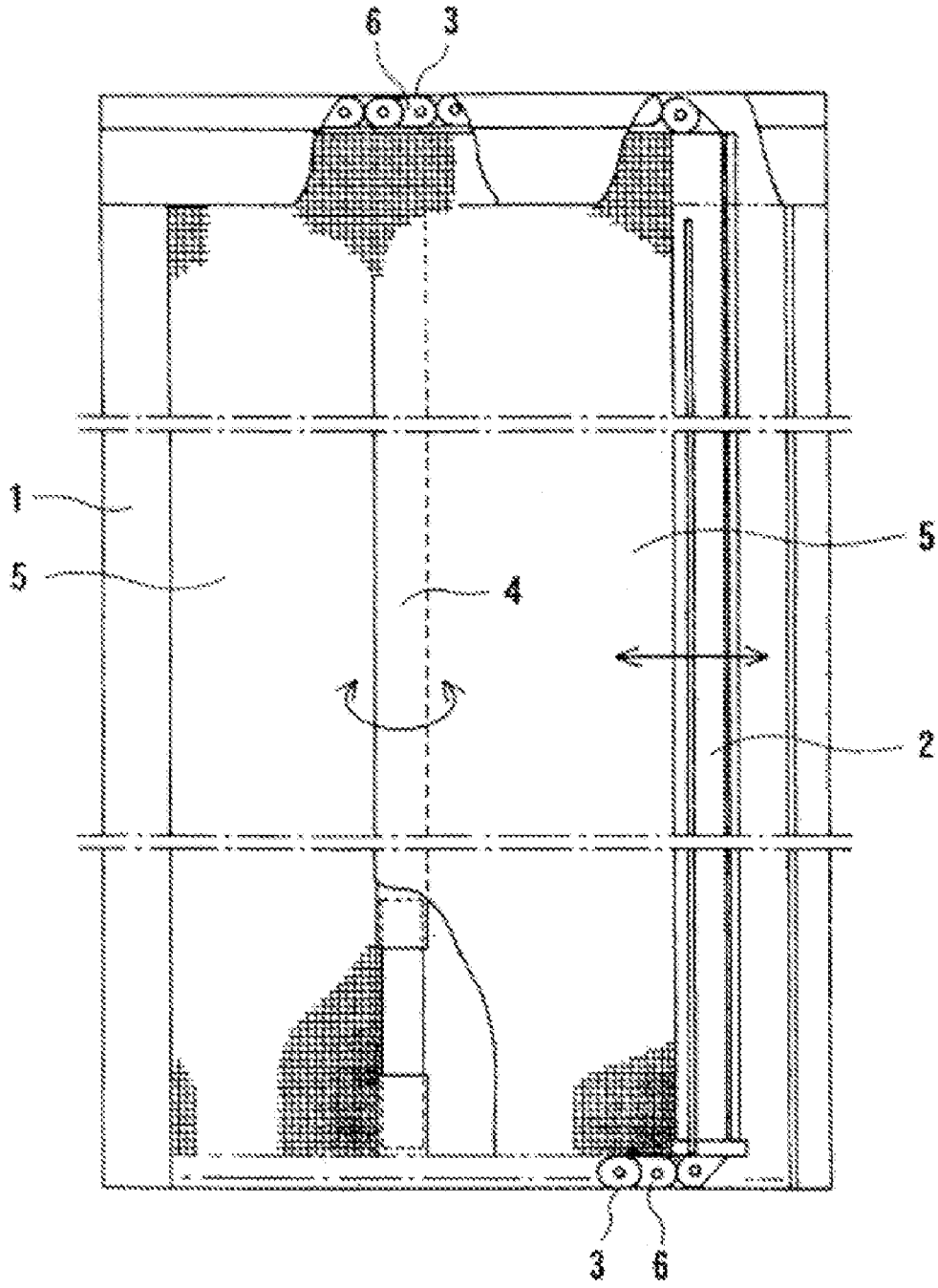
Fig. 5 PRIOR ART
FIG. 5 is a front view showing a screen device as proposed heretofore with a part thereof cut out.

With the screen device shown in FIG. 1, one end of each of the slide guide frames 3 is not fixed to the stationary frame 1 but is free at both ends thereof, whereby the slide guide frames 3 can be received in not only the slide bar 2 but also the stationary frame 1 when the screen device is opened. Accordingly, a length, over which the slide guide frames 3 are developed, is elongated to a length being the sum of substantially half of a length of the slide bar 2 and substantially half of a length of the stationary frame 1, so that a ratio of an opening and closing width of the screen device to a length thereof in a direction perpendicular to the opening and closing width, that is, a height of the screen device is increased as compared with that of the screen device shown in FIG. 5. Therefore, the screen device is increased in freedom of design.

The upper and lower slide guide frames 3 are joined together at free ends thereof by a tension member 8, such as string, etc., which defines a loop in the shape of the FIG. 8. The tension member 8 is provided in order to enable smooth and stable development and reception of the slide guide frames 3, and received in the slide bar 2 and the stationary frame 1, respectively.

Figure 2:
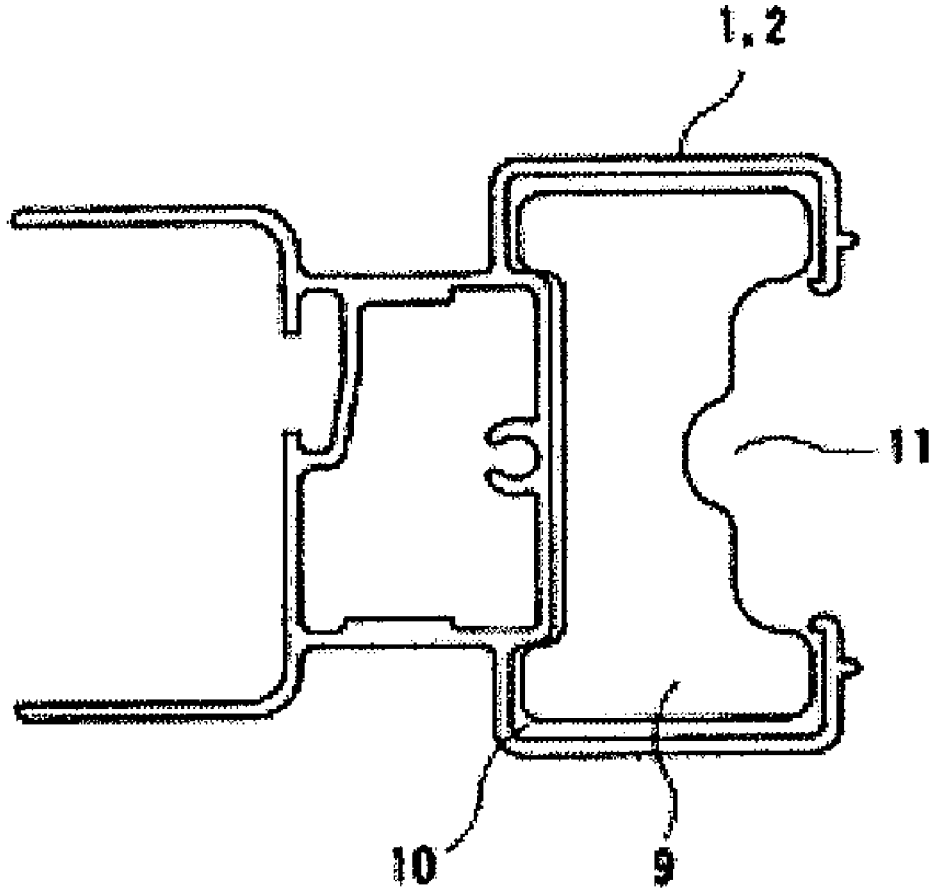
FIG. 2 is a cross sectional view showing a configuration, in which weights are received in a slide bar and a stationary frame in the screen device shown in FIG. 1.

Also, with the screen device shown in FIG. 1, weights 9 are put on respective free ends of the lower slide guide frame 3 arranged on a lower side. The weights 9 are received in storage spaces 10, for the slide guide frames 3, formed on the slide bar 2 and the stationary frame 1. As shown in FIG. 2, the weights 9 have cross sectional shapes conformed to storage spaces 10, for the slide guide frames 3, formed on the slide bar 2 and the stationary frame 1, and are formed with recesses 11 so as to eliminate interference with the tension member 8 arranged in the storage spaces 10. Therefore, the weights 9 are movable in a vertical direction, that is, a height direction in the storage spaces 10 formed in the slide bar 2 and the stationary frame 1, and movements in the height direction interlock with development and reception of the slide guide frames 3 since the weights 9 are put on the free ends of the lower slide guide frame 3.

As described above, the slide bar 2 is put in a state of being pulled toward the stationary frame 1 by the coil spring 7 received in the roller pipe 4 at all times, and so a force, with which the coil spring 7 winds the screens 5, acts in a direction, in which the slide guide frames 3 are received into the slide bar 2 and the stationary frame 1, that is, in a direction of ascent at the free ends. In contrast, the gravitational force acting on the weights 9 acts in a manner to lower the free ends of the slide guide frames 3. Accordingly, a part of the force, with which the coil spring 7 winds the screens 5, is canceled by the gravitational force acting on the weights 9. That is, a part of the work done by the force with which the coil spring 7 winds the screens 5, in receiving the slide guide frames 3 in the slide bar 2 and the stationary frame 1 is consumed for an increase of the weights 9 in potential energy. In this manner, the weights 9 brake reception of the slide guide frames 3 owing to an increase in potential energy. Accordingly, even when the elastic restoring force accumulated in the coil spring 7 is released at the time of opening of the screen device, reception of the slide guide frames 3 is braked by an increase of the weights 9 in potential energy and reception of the slide guide frames 3 is decelerated, so that the slide bar 2 is slid gently and not forcibly slid toward the stationary frame 1. Even when tension of the screens 5 is larger than a force required for winding in order to prevent the screens 5 from being bent by wind pressure at the time of closing of the screen device, that speed, at which the slide bar 2 is slid, can be adjusted by adjusting the mass of the weights 9. The slide bar 2 is not forcibly slid toward the stationary frame 1 at the time of opening of the screen device and so the screen device has improved safety.

Also, the gravitational force acting on the weights 9 acts in a direction, in which the free ends of the slide guide frame 3 are caused to descend, that is, so as to develop the slide guide frames 3. Accordingly, a part of the force, with which the coil spring 7 winds the screens 5, is canceled by the gravitational force acting on the weights 9. That is, owing to a decrease in potential energy, the weights 9 promote development of the slide guide frames 3. Therefore, it is possible to decrease an operating force being applied to the slide bar 2 at the time of closing of the screen device, so that a feeling of operating the slide bar 2 becomes light.

Actually, a coil spring 7, whose maximum torque when the screens 5 are pulled out is 3 kg·cm, is received in a roller pipe 4 having an outside diameter of 20 mm, and weights 9 made of brass of 300 g are put on respective free ends of a lower slide guide frame 3, and received in storage spaces 10, for the slide guide frames 3, formed on a slide bar 2 and a stationary frame 1.

With a screen device, on which weights 9 are not arranged, an operating force being applied to a slide bar 2 to pull out screens 5 was 3.2 kgf at maximum but could be decreased to 2.6 kgf by the arrangement of the weights 9 in the manner described above. Also, speed, at which the slide bar 2 is slid at the time of opening of the screen device, became small and the gravitational force acting on the weights 9 in the vicinity of the stationary frame 1 balanced a force of the coil spring 7 required for winding the screens 5, so that speed, at which the slide bar 2*s* slid, becomes substantially zero.

In addition, with the screen device, in which slide guide frames 3 can be freely developed from and received in a stationary frame 1 together with a slide bar 2, it suffices that a weight 9 is received in at least one of the slide bar 2 and the stationary frame 1 and it is not necessarily required that weights be provided on both the slide bar 2 and the stationary frame 1. Provided that a mass required for a weight 9 is realized, it can be received in either of the slide bar 2 and the stationary frame 1. Accordingly, with the screen device in which one ends are free, development from and reception in the slide bar 2 are made possible, and the other ends are fixed to the stationary frame 1, shown in FIG. 5, the weights 9 can be received in the slide bar 2.

Also, since the weight 9 is received in at least one of the slide bar 2 and the stationary frame 1, the storage space 10, for the slide guide frame 3 formed on the slide bar 2 or the stationary frame 1 can be effectively used for reception of the weight 9 while a favorable outward appearance is maintained.

With the screen device according to the invention, the arrangement of the weights 9 is not limited in configuration to that arrangement, in which the weights are put on free ends of the slide guide frames 3.

Figure 3:
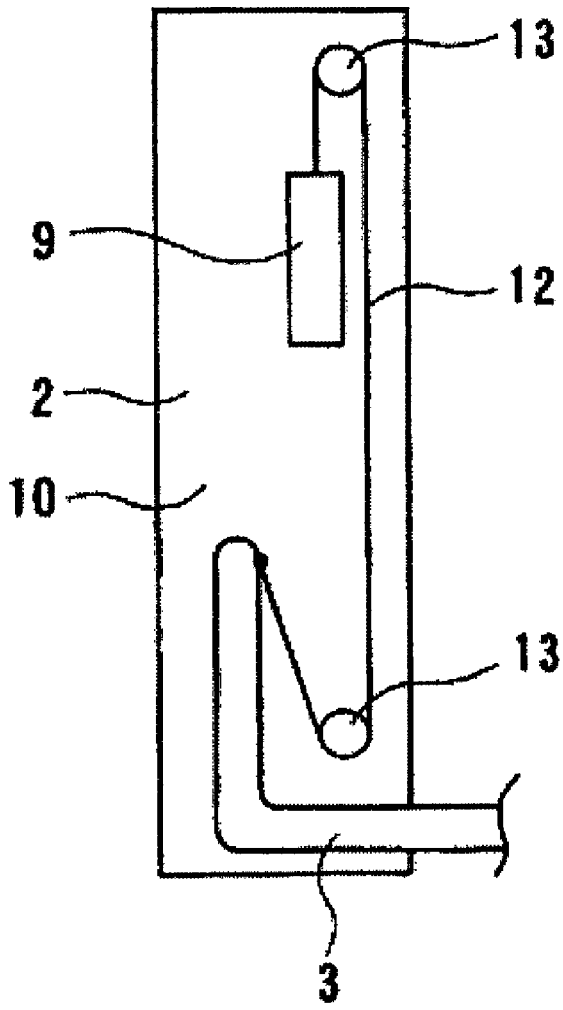
FIG. 3 is a schematic, cross sectional view illustrating an essential part of a configuration, in which a weight is arranged in a screen device according to the invention.

As shown in, for example, FIG. 3, it is possible to join an end of a tension member 12 such as a string, etc. to a free end of a lower slide guide frame 3, to arrange direction change members 13, such as a pulley, etc., at lower and upper ends of a slide bar 2 in a storage space 10 for a slide guide frame 3, to stretch the tension member 12 to the upper direction change member 13 from the lower direction change member 13, and to fix a weight 9 to the other end of the tension member 12 hanging from the upper direction change member 13.

Also, in this case, interlocking with development and reception of the slide guide frames 3, the weight 9 can move in the storage space 10 of the slide bar 2 for the slide guide frame 3 in a height direction, and when the slide guide frames 3 are to be received, the weight 9 is pulled upward, so that the weight 9 is increased in potential energy. When the slide guide frames 3 are to be developed, the weight 9 descends, so that it is decreased in potential energy. Accordingly, owing to an increase in potential energy, the weight 9 brakes reception of the slide guide frames 3 and promotes development of the slide guide frames 3 owing to a decrease in potential energy.

Figure 4:
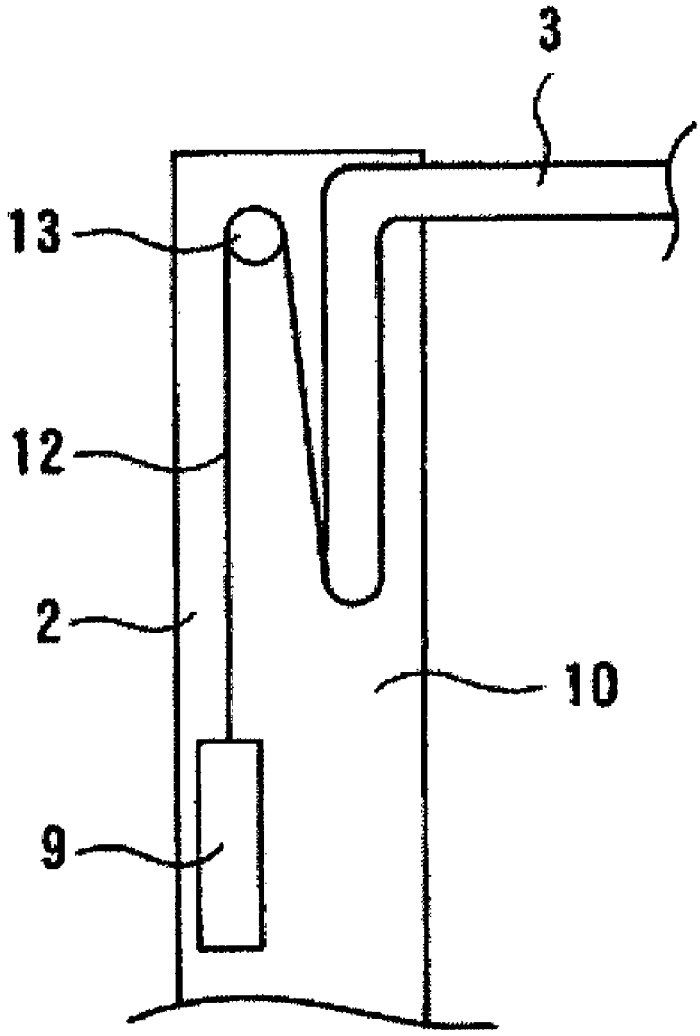
FIG. 4 is a schematic, cross sectional view illustrating an essential part of a configuration, in which a weight is arranged in a screen device according to the invention.

Also, as shown in FIG. 4, a weight 9 can brake reception of an upper slide guide frame 3 and promote development thereof. With the screen device shown in FIG. 4, one end of a tension member 12 such as a string, etc. is joined to a free end of an upper slide guide frame 3, a direction change member 13 such as pulley, etc. is arranged at an upper end of a slide bar 2 in a storage space 10 for a slide guide frame 3, the tension member 12 is stretched round the direction change member 13, and the weight 9 is fixed to the other end of the hanging tension member 12.

Also, in this case, interlocking with development and reception of the slide guide frames 3, the weight 9 can move in the storage space 10 of the slide bar 2 for the slide guide frame 3 in a height direction, and when the slide guide frame 3 is to be received, the weight 9 is pulled upward, so that the weight 9 is increased in potential energy. When the slide guide frame 3 is to be developed, the weight 9 descends, so that it is decreased in potential energy. Accordingly, owing to an increase in potential energy, the weight 9 brakes reception of the slide guide frame 3 and promotes development of the slide guide frame 3 owing to a decrease in potential energy.

In this manner, the weight 9, which brakes reception of the upper slide guide frame 3 and promotes development thereof, can be fixed directly to the free end of the slide guide frame 3 without the medium of a tension member 12. Also, braking of reception of and promotion of development of the slide guide frame 3, both of which are effected by the weight 9, can be applied not only to one of the slide guide frames 3 but also to both slide guide frames 3. This can be appropriately selected according to the magnitude of a force of the coil spring 7, which is received in the roller pipe 4 to wind the screens 5.

In addition, while reception of the weights 9 is significant in making effective use of the storage spaces 10, for the slide guide frames 3, formed on the slide bar 2 and the stationary frame 1, reception of the weights 9 decreases the storage spaces 10 in a vertical direction, so that in order to sufficiently elongate a length, over which the slide guide frames 3 are developed, it is preferable in the screen device shown in FIG. 1 to arrange the weights 9 one by one on the slide bar 2 and the stationary frame 1, respectively.

Also, the screen device shown in FIG. 1 is provided with a stopper mechanism, by which the screen device is held in a closed state. The stopper mechanism is mounted to a longitudinal frame 14 arranged in opposition to the stationary frame 1 and includes a lever 15, which slides vertically, and an opening member 16 provided on the slide bar 2. The opening member 16 is provided with an opening 17. The lever 15 is provided with a hook 18, which is opposed to the opening 17 to project laterally. The hook 18 is made integral with the lever 15, so that the hook 18 also moves up and down as the lever 15 slides.

When the slide bar 2 is caused to slide to the longitudinal frame 14 at the time of closing of the screen device, the hook 18 enters into the opening 17 of the opening member 16 to have its tip end caught by the opening member 16 disposed at a peripheral edge of the opening 17. While the screen device is biased in a direction of opening, movements of the slide bar 2 are braked by virtue of being thus caught and the screen device is held stably in a closed state.

When the screen device is to be opened, the lever 15 is pushed upward. Then, the hook 18 moves upward to have its tip end coming off the peripheral edge of the opening 17 to be released from a state of being caught. The slide bar 2 can be slid toward the stationary frame 1. In addition, an elastic member, such as spring, etc., which provides for downward bias, can be connected to the lever 15, so that as the hook 18 is released from a state of being caught, the lever 15 can be automatically returned to an initial position.

The invention provides a screen device, in which an operating force is decreased so as to make a nimble feeling, with which a slide bar is operated, and the sliding speed of the slide bar is decreased at the time of closing to achieve improvement in safety.

The invention claimed is:

1. A screen device comprising:

a pair of slide guide frames; and a rotatable roller pipe arranged between the pair of slide guide frames, each slide guide frame of the slide guide frames being free at both ends thereof, and capable of development from and reception in both a stationary frame and a slide bar slidable relative to the stationary frame, the roller pipe being capable of sliding in a sliding direction of the slide bar, the roller pipe having one end of each of a first and second screen fixed thereto to enable the first and second screens to be wound around and pulled out from the roller pipe, the roller pipe having a coil spring disposed therein, the roller pipe being configured to rotate and slide in the sliding direction of the slide bar to accumulate an elastic restoring force in the coil spring when the slide bar is slid to pull out the first and second screens, the accumulated elastic restoring force being capable of being released to cause the first and second screens to be wound around the roller pipe, the roller pipe being capable of sliding toward the stationary frame, and the slide bar also being capable of sliding toward the stationary frame, wherein a weight is configured and arranged so as to move in a height direction simultaneously with the development and reception of the slide guide frames, and the weight is configured and arranged so as to brake reception of the slide guide frames due to an increase in potential energy and promote development of the slide guide frames due to a decrease in potential energy.

2. The screen device according to claim 1, wherein the weight is disposed in at least one of the slide bar and the stationary frame.

3. The screen device according to claim 2, wherein the weight has a cross sectional shape conformed to a storage space, for the slide guide frame, formed on the slide bar or the stationary frame.

4. The screen device according to claim 3, wherein the pair of slide guide frames are joined together at least one free end thereof by a tension member, which defines a loop, the tension member is received in the slide bar or the stationary frame, and the weight has a recess, through which the tension member is inserted.

* * * * *